US009909780B2

(12) United States Patent
Humphrey et al.

(10) Patent No.: US 9,909,780 B2
(45) Date of Patent: Mar. 6, 2018

(54) SYSTEM CONTROL FOR TANK RECOVERY

(71) Applicant: Rinnai America Corporation, Peachtree City, GA (US)

(72) Inventors: Scott Gilman Humphrey, Powder Springs, GA (US); Jason William Siler, Sharpsburg, GA (US)

(73) Assignee: RINNAI AMERICA CORPORATION, Peachtree City, GA (US)

( * ) Notice: Subject to any disclaimer, the term of this patent is extended or adjusted under 35 U.S.C. 154(b) by 242 days.

(21) Appl. No.: 15/064,116

(22) Filed: Mar. 8, 2016

(65) Prior Publication Data

US 2016/0265810 A1 Sep. 15, 2016

Related U.S. Application Data

(60) Provisional application No. 62/131,567, filed on Mar. 11, 2015.

(51) Int. Cl.
*F24H 9/20* (2006.01)

(52) U.S. Cl.
CPC ..... *F24H 9/2021* (2013.01); *F24H 9/2028* (2013.01); *F24H 9/2035* (2013.01)

(58) Field of Classification Search
CPC ..... F24H 9/2021; F24H 1/125
See application file for complete search history.

(56) References Cited

U.S. PATENT DOCUMENTS 4,970,373 A * 11/1990 Lutz ..... F24H 9/2028 219/492
5,233,970 A * 8/1993 Harris ..... F24D 3/082 122/14.22
5,322,216 A 6/1994 Wolter et al.
7,460,769 B2 * 12/2008 Ryks ..... F24H 1/08 392/441
9,243,848 B2 1/2016 Evans et al.
2006/0230772 A1 10/2006 Wacknov et al.
2008/0197205 A1 * 8/2008 Ene ..... F24H 1/43 237/19
2012/0060772 A1 3/2012 Roy
(Continued)

*Primary Examiner* — Gregory A Wilson
(74) *Attorney, Agent, or Firm* — Burr & Forman LLP; Harvey S. Kauget

(57) ABSTRACT

The present invention is a system for tank recovery comprising a tankless having an outlet and a storage tank that is operatively connected to the tankless. A pump is operatively connected to the tankless and the pump is operatively connected to the storage tank. A first thermistor is in thermal communication with the outlet of the tankless. The first thermistor measures a first temperature of the outlet of the tankless when the pump is active. A second thermistor is in thermal communication with the storage tank. The second thermistor measures a second temperature of the storage tank. A controller has a stored default temperature for the tankless. The controller receives the measured second temperature from the second thermistor. The controller compares the stored default temperature for the tankless to the measured second temperature from the second thermistor. The controller sends a first signal to activate the pump when the difference between the stored temperature and the measured second temperature is greater than a first set temperature.

20 Claims, 2 Drawing Sheets

(56) References Cited

U.S. PATENT DOCUMENTS

| | | | | |
|---|---|---|---|---|
| 2012/0060827 | A1* | 3/2012 | Roetker | F24H 1/145<br>126/587 |
| 2012/0247403 | A1* | 10/2012 | Im | F24H 1/101<br>122/14.1 |
| 2014/0209042 | A1* | 7/2014 | Hardesty | F24H 1/186<br>122/14.3 |
| 2014/0229022 | A1 | 8/2014 | Deivasigamani et al. | |
| 2015/0047578 | A1* | 2/2015 | Lesage | F24H 1/08<br>122/14.22 |
| 2016/0003468 | A1* | 1/2016 | Malone | F22B 1/08<br>122/15.1 |

* cited by examiner

SYSTEM CONTROL FOR TANK RECOVERY

CROSS REFERENCES TO RELATED APPLICATIONS

This application claims priority from and is related to commonly owned U.S. Provisional Patent Application Ser. No. 62/131,567 filed Mar. 11, 2015, entitled: IMPROVED TANKLESS TEMPERATURE CONTROL SYSTEM, this Provisional patent application incorporated by reference herein.

FIELD OF THE INVENTION

This invention relates to water heater controls for tankless fluid heaters.

BACKGROUND OF THE INVENTION

The need for heated fluids, and in particular heated water, has long been recognized. Conventionally, water has been heated by heating elements, either electrically or with gas burners, while stored in a tank or reservoir. While effective, energy efficiency and water conservation using a storage tank alone can be poor. As an example, water that is stored in a hot water storage tank is maintained at a desired temperature at all times. Thus, unless the storage tank is well insulated, heat loss through radiation can occur, requiring additional input of energy to maintain the desired temperature. In effect, continual heating of the stored water in the storage tank is required. Additionally, the storage tank is often positioned at a distance from the point of use, such as the hot water outlet. In order to obtain a desired temperature, cooled water in the pipes connecting the point of use (outlet) and the hot water storage tank must be purged before the hot water from the storage tank reaches the outlet. This can often amount to a substantial volume of water being wasted.

Many of these problems have been overcome by the use of tankless water heaters. With the tankless water heater, incoming ground water passes through a component generally known as a heat exchanger and is instantaneously heated by heating elements (or gas burner) within the heat exchanger until the temperature of the water leaving the heat exchanger matches a desired temperature set by a user of the system. With such systems the heat exchanger is typically heated by a large current flow (or Gas/BTU input) which is regulated by an electronic control system. The electronic control system also typically includes a temperature selection device, such as a thermostat, by which the user of the system can select the desired temperature of the water being output from the heat exchanger.

Controllers are available on the market to activate a pump based on a change in temperature in the storage tank. The problem with current market controllers is that the set temperature would need to be set at the controller and at the tankless water heater. This presents the possibility for the user to set the system incorrectly or outside of a manufacturer's recommendation for the system. For example, the user could set the tankless to 120° F. and the controller to 140° F. In this case the pump would run continuously because the 120° F. exiting the tankless would never satisfy the controller set temperature of 140° F.

Therefore, it is an object of the present invention to provide an improvement which overcomes the inadequacies of the prior art methods and devices and which is a significant contribution to the advancement of the water heater art.

Another object of the present invention is to provide a system for tank recovery comprising: a tankless having an outlet; a storage tank operatively connected to said tankless; a pump operatively connected to said tankless, said pump operatively connected to said storage tank; a first thermistor in thermal communication with said outlet of said tankless, said first thermistor measures a first temperature of said outlet of said tankless when said pump is active; a second thermistor in thermal communication with said storage tank, said second thermistor measures a second temperature of said storage tank; and a controller having a stored default temperature for said tankless, said controller receives the measured second temperature from said second thermistor, said controller compares the stored default temperature for said tankless to the measured second temperature from said second thermistor, said controller sends a first signal to activate said pump when the difference between the stored temperature and the measured second temperature is greater than a first set temperature.

Yet another object of the present invention is to provide a method for tank recovery comprising: providing a tankless having an outlet; providing a storage tank operatively connected to said tankless; providing a pump operatively connected to said tankless, said pump operatively connected to said storage tank; providing a first thermistor in thermal communication with said outlet of said tankless, said thermistor measuring a first temperature; providing a second thermistor in thermal communication with said storage tank, said second thermistor measuring a second temperature; providing a controller operatively connected to said first thermistor, said controller operatively connected to said second thermistor, and said controller operatively connected to said pump; storing a default first temperature in said controller; monitoring the second temperature received by said controller from said second thermistor; comparing the second temperature to the default first temperature by said controller; sending a first signal from said controller to said pump when a first set point is reached based on the comparison of the second temperature to the default first temperature by said controller, the first signal activating said pump; monitoring the first temperature received by said controller from said first thermistor, the monitoring of the first temperature occurring while said pump is activated; comparing the second temperature to the first temperature by said controller; sending a second signal from said controller to said pump when a second set point is reached based on the comparison of the second temperature to the first temperature by said controller, the second signal deactivating said pump; discontinuing the monitoring of the first temperature by said controller when said pump is deactivated; and storing an updated first temperature in said controller when said pump is deactivated by the second signal.

The foregoing has outlined some of the pertinent objects of the present invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

A feature of the present invention is to provide a system for tank recovery comprising a tankless having an outlet and a storage tank operatively connected to the tankless. A pump is operatively connected to the tankless and the pump is operatively connected to the storage tank. A first thermistor is in thermal communication with the outlet of the tankless. The first thermistor measures a first temperature of the outlet of the tankless when the pump is active. A second thermistor is in thermal communication with the storage tank. The second thermistor measures a second temperature of the storage tank. A controller that has a stored default temperature for the tankless receives the measured second temperature from the second thermistor. The controller compares the stored default temperature for the tankless to the measured second temperature from the second thermistor. The controller sends a first signal to activate the pump when the difference between the stored temperature and the measured second temperature is greater than a first set temperature. The controller can receive the measured first temperature from the first thermistor when the pump is active. The controller can send a second signal to deactivate the pump when the difference between the measured first temperature and the measured second temperature is less than a second set temperature. The controller can store an updated first temperature when the difference between the measured first temperature and the measured second temperature is less than the second set temperature. The controller can send a third signal to deactivate the pump when the measured second temperature is greater than a third set temperature. A first relay can be operatively connected to the controller and the relay can be operatively connected to the pump. The thermistor can further comprise a second temperature sensor that measures the second temperature of the storage tank. The second temperature sensor can be positioned within the storage tank. The first thermistor can further comprise a first temperature sensor that measures the first temperature of the tankless. The first temperature sensor can be positioned on a surface of the tankless.

Another feature of the present invention is to provide a method for tank recovery comprising a tankless having an outlet is provided along with a storage tank that is operatively connected to the tankless. A pump that is operatively connected to the tankless and that is operatively connected to the storage tank is provided. A first thermistor that is in thermal communication with the outlet of the tankless is provided. The first thermistor measures a first temperature of the outlet of the tankless. A second thermistor in thermal communication with the storage tank is provided. The second thermistor measures a second temperature of the storage tank. A controller that is operatively connected to the first thermistor is provided. The controller is operatively connected to the second thermistor and the pump. A default first temperature is stored in the controller. The second temperature is monitored and is received by the controller from the second thermistor. The second temperature is compared to the default first temperature by the controller. A first signal is sent from the controller to the pump when a first set point is reached based on the comparison of the second temperature to the default first temperature by the controller. The first signal activates the pump. The first temperature is monitored and received by the controller from the first thermistor. The monitoring of the first temperature occurs while the pump is activated. The second temperature is compared to the first monitored temperature by the controller. A second signal is sent from the controller to the pump when a second set point is reached based on the comparison of the second temperature to the first monitored temperature by the controller. The second signal deactivates the pump. The monitoring of the first temperature is discontinued by the controller when the pump is deactivated. An updated first temperature is stored in the controller when the pump is deactivated by the second signal. The first set point can occur when the difference between the first default temperature and the second temperature is greater than a first set temperature. The second set point can occur when the difference between the first temperature and the second temperature is less than a second set temperature. The method can further comprise the second temperature being compared to the updated first temperature by the controller while the pump is deactivated and a third signal from the controller being sent to the pump when the first set temperature is reached. The third signal activates the pump. The first set temperature can be about ten degrees Fahrenheit. The second set temperature can be about ten degrees Fahrenheit. The method can further comprise the second temperature being compared to a third set temperature by the controller and a fourth signal from the controller being sent to the pump if the second temperature is less than the third set temperature. The fourth signal activates the pump. The method can further comprise the second temperature being compared to the third set temperature by the controller and a fifth signal from the controller being sent to the pump if the second temperature is greater than the third set temperature. The fifth signal deactivates the pump. The third set temperature can be about one hundred thirty-five degrees Fahrenheit. The method can further comprise a first relay that is operatively connected to the controller and the relay is operatively connected to the pump. The second thermistor can further comprise a second temperature sensor that measures the second temperature. The second temperature sensor can be positioned within the storage tank. The first thermistor can further comprise a first temperature sensor that measures the temperature of the tankless. The first temperature sensor can be positioned on a surface of the tankless.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

Similar reference characters refer to similar parts throughout the several views of the drawings.

DETAILED DESCRIPTION OF THE INVENTION

Figure 1:
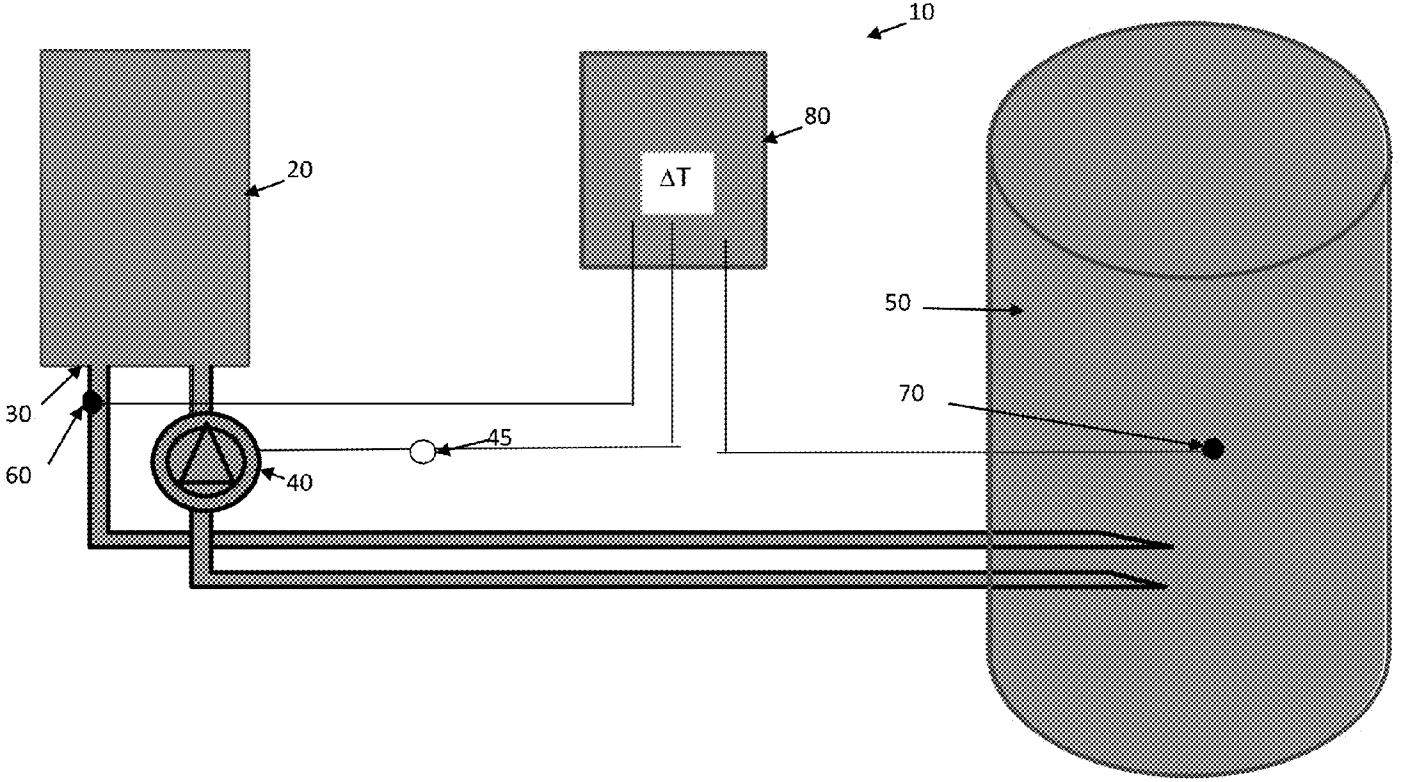
FIG. 1 is a schematic view of one embodiment of the present invention.

Referring to FIG. 1, there is shown one embodiment of the present invention. The tank recovery system 10 has a tankless 20 which has an outlet 30 and a pump 40. A storage tank 50 is operatively connected to the tankless 20. A first thermistor 60 is in thermal communication with the outlet 30. A second thermistor 70 is in thermal communication with the storage tank 50. A controller 80 is operatively connected to the pump 40 through a relay 45. The controller 80 receives the temperature of the tankless 20 from the first thermistor 60. The first thermistor 60 can further comprise a first temperature sensor that can be positioned on a surface of the tankless 20 or the sensor can be submerged in the tankless 20. In addition, the controller 80 receives the temperature of the storage tank 50 from the second thermistor 70. The second thermistor can further comprise a second temperature sensor that can be positioned on a surface of the storage tank 50 or the sensor can be submerged in the storage tank 50.

Figure 2:
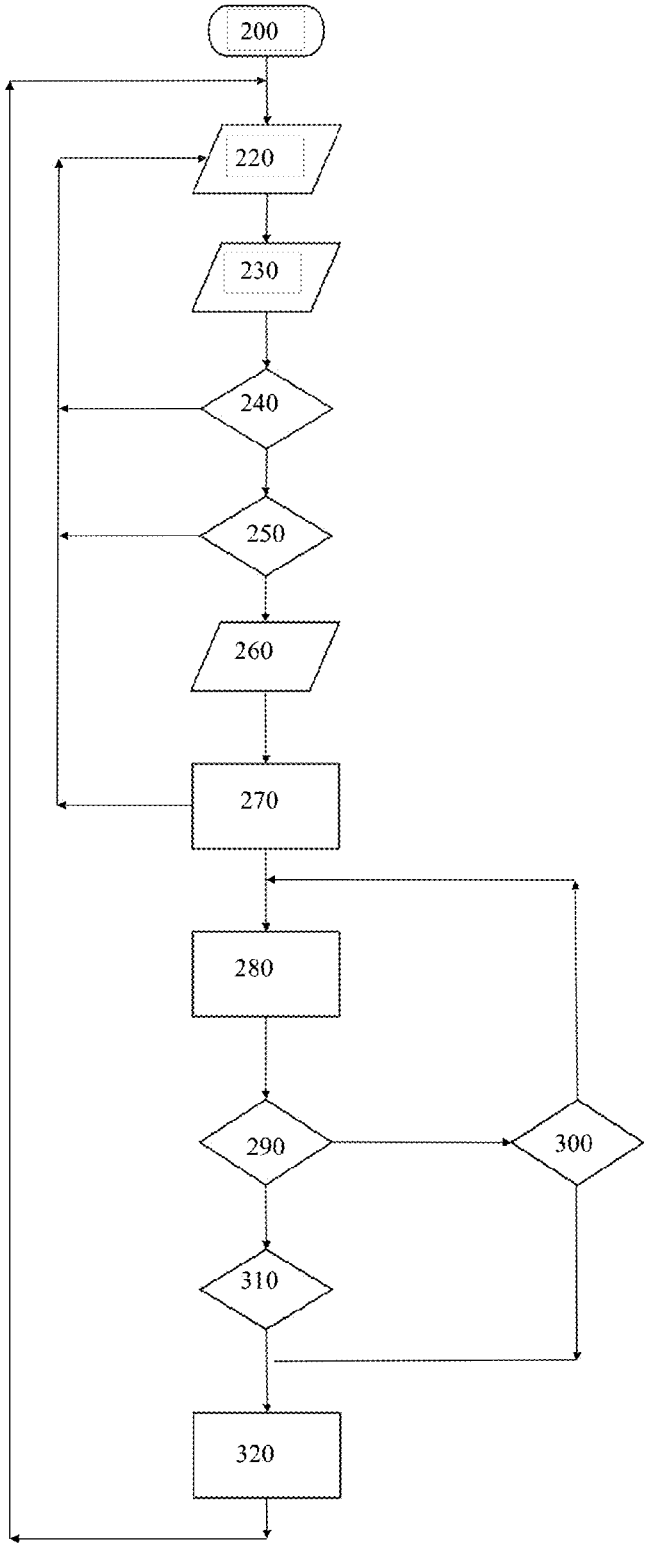
FIG. 2 is a flowchart of one embodiment of the present invention.

FIG. 2 is a flow diagram of one embodiment of the present invention and is described as follows. At starting step 200, the controller stores a default set temperature equal to about one hundred eighty-five degrees Fahrenheit for the temperature measurement of the tankless. The one hundred eighty-five degrees Fahrenheit temperature will be the start temperature at commission of the tankless and will also be the reset temperature with a power failure or power reset of the system.

At input/output step 220, the controller will send a signal to turn off the pump relay.

At input/output step 230, the controller will continuously monitor the temperature of the storage tank.

At decision step 240, the controller will compare the monitored temperature of the storage tank to the default set temperature of the tankless or the last stored temperature of the tankless. If the differential in temperature is greater than about ten degrees Fahrenheit, then the controller will send a signal to the relay to activate the pump. Whereas, if the differential in temperature is less than about ten degrees Fahrenheit, then the controller will send a signal to the relay to deactivate the pump.

At decision step 250, if the storage tank temperature is less than about one hundred thirty-five degrees Fahrenheit, then the controller will send a signal to the relay to activate the pump. Whereas, if the storage tank temperature is greater than about one hundred thirty-five degrees Fahrenheit, then the controller will send a signal to the relay to deactivate the pump.

At input/output step 260, the relay activates the pump to draw water from the bottom of the storage tank and into the tankless. The tankless will heat the water to the temperature selected on the tankless control. The heated water will exit the tankless and enter into the top of the storage tank.

At process step 270, the controller will wait about fifty seconds before monitoring the temperature of the tankless. The controller will continue to monitor the temperature of the storage tank. If the storage tank temperature is greater than about one hundred thirty-five degrees Fahrenheit, then the controller will send a signal to the relay to deactivate the pump.

At process step 280, the pump is active and the controller monitors the actual temperature of the storage tank as compared to the actual temperature of the tankless.

At decision step 290, the controller will check if the temperature of the storage tank is less than or equal to the maximum allowed temperature of about one hundred forty degrees Fahrenheit.

At decision step 300, if the temperature of the storage tank is about one hundred forty degrees Fahrenheit or less, the controller will check if the storage tank temperature minus the tankless temperature is greater than about two degrees Fahrenheit. If the differential is greater than about two degrees Fahrenheit, then the controller will allow the pump to still be activated and the controller will continue to monitor the storage tank temperature and the tankless temperature. Whereas, if differential is less than about two degrees Fahrenheit, then the controller will store a new set temperature equal to the outlet temperature of the tankless, send a signal to the relay to deactivate the pump and the controller will continue to monitor the storage tank temperature.

At decision step 310, if the temperature of tankless is greater than about one hundred forty degrees Fahrenheit and the storage tank temperature is within two degrees Fahrenheit of about one hundred forty degrees Fahrenheit, then the controller will store a new set temperature equal to the outlet temperature of the tankless, send a signal to the relay to deactivate the pump and the controller will continue to monitor the storage tank temperature.

At process step 320, the controller will store a new set temperature equal to the outlet temperature of the tankless, send a signal to the relay to deactivate the pump and the controller will continue to monitor the storage tank temperature.

The temperatures and times given in the flow diagram of FIG. 2 are preferred embodiments of the present invention. Nevertheless, the temperatures and times can be changed as preferred by a customer using a system that is using the present invention.

The preferred embodiment is to have temperature selection and adjustment maintained at the tankless unit. The tankless unit will heat the water to the consumers preferred temperature setting. The tankless controller is the only needed customer interface. No adjustment is required on the control module. Controller will be preprogramed to a selected default set temperature. This default set temperature will be updated as described herein. In the event of a power failure, the controller will reset to the default set temperature when power is restored. The default set temperature will be programmed into the controller. The default set temperature should be greater than the anticipated ground water temperature and greater than any possible selectable temperature of the tankless.

T1 (tankless outlet temp) is the controller input that communicates the selected tankless temperature to the controller). T1 is a temperature sensor on the hot outlet side of the tankless water heater. This sensor could also be either surface mount or submersible.

The controller hardware includes Input for T1 Thermistor (tankless), Input T2 Thermistor (Tank), and Output 120 volt relay for pump activation and deactivation. There is the additional controller feature of a 120 volt power (constant) for tankless water heater. Controller Logic T1 (tankless thermistor) is a temperature input to the controller. The controller will read this temperature only when the pump (120 volt relay) is activated. When the pump is not activated, the controller will hold the last temperature recorded and store that as the set temperature. T2 (tank thermistor) is an input to the controller. The controller will see this as the tank temperature. When the tank temperature (T2) drops below a pre-determined value below the T1 value, the controller will activate the 120 volt relay to power the pump. The pump will circulate the water from the tank into the tankless and activate the tankless. The tankless unit will heat the water to the consumers preferred temperature setting and return this temperature water to the tank. When the tank temperature returns to a predetermined differential to the set temperature, the controller will de-activate the 120 volt relay and the controller will store the last T1 temperature recorded. If the user changes the set temperature of the tankless unit, the controller will still respond based on the previous cycle temperature T1, but as soon as the pump activates and the tankless heats the water, T1 will change based on the users temperature selection.

Controller will be preprogrammed to a selected temperature. T1 is a temperature sensor on the hot outlet side of the tankless water heater. T2 is a temperature sensor to measure the water inside the storage tank. This could either be a surface mount sensor or a submerged sensor. When powered up, the storage tank temperature T2 will recognize and read the temperature in the storage tank and send it to the controller. At initial operation the water temperature inside the storage tank will be at ground water temperature forty to eighty degrees Fahrenheit.

When the controller activates the pump, the controller will wait fifty seconds before measuring T1 (tankless outlet temperature). The value of fifty seconds may change based on test results. We need to wait at this point in the control scheme to allow the tankless water heater to stabilize the outlet temperature before evaluating T1-T2. While the tankless is in operation (120 volts from controller to pump) the controller will continue to monitor the temperature T1 and T2. If the tank temperature is below the tankless outlet temperature the pump and tankless will continue to run and the controller will continue monitoring the temperatures.

When T2=T1, the system is satisfied. Before turning off the pump, the controller will need to record and hold T1 "Update T1." It is important that the Controller stop reading T1 and hold the T1 value as the new set temperature. This is one of the most unique parts of this control logic. If the controller continued to monitor the tankless outlet temperature, the outlet temperature T1 will drop much faster than that of the water inside the insulated tank resulting in continuous cycling of the system.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

We claim:

1. A system for tank recovery comprising:

a tankless having an outlet;

a storage tank operatively connected to said tankless;

a pump operatively connected to said tankless, said pump operatively connected to said storage tank;

a first thermistor in thermal communication with said outlet of said tankless, said first thermistor measures a first temperature of said outlet of said tankless when said pump is active;

a second thermistor in thermal communication with said storage tank, said second thermistor measures a second temperature of said storage tank; and a controller having a stored default temperature for said tankless, said controller receives the measured second temperature from said second thermistor, said controller compares the stored default temperature for said tankless to the measured second temperature from said second thermistor, said controller sends a first signal to activate said pump when the difference between the stored temperature and the measured second temperature is greater than a first set temperature.

2. The system according to claim 1, further comprising said controller receives the measured first temperature from said first thermistor when said pump is active.

3. The system according to claim 2, further comprising said controller sends a second signal to deactivate said pump when the difference between the measured first temperature and the measured second temperature is less than a second set temperature.

4. The system according to claim 3, further comprising said controller stores an updated first temperature when the difference between the measured first temperature and the measured second temperature is less than the second set temperature.

5. The system according to claim 4, further comprising said controller sends a third signal to deactivate said pump when the measured second temperature is greater than a third set temperature.

6. The system according to claim 5, further comprising a first relay, said first relay operatively connected to said controller and said relay operatively connected to said pump.

7. The system according to claim 6, wherein said second thermistor further comprising a second temperature sensor, said second temperature sensor measures said second temperature of said storage tank, said second temperature sensor is positioned within said storage tank.

8. The system according to claim 7, wherein said first thermistor further comprising a first temperature sensor, said first temperature sensor measures said first temperature of said tankless, said first temperature sensor is positioned on a surface of said tankless.

9. A method for tank recovery comprising:

providing a tankless having an outlet;

providing a storage tank operatively connected to said tankless;

providing a pump operatively connected to said tankless, said pump operatively connected to said storage tank;

providing a first thermistor in thermal communication with said outlet of said tankless, said first thermistor measuring a first temperature of said outlet of said tankless;

providing a second thermistor in thermal communication with said storage tank, said second thermistor measuring a second temperature of said storage tank;

providing a controller operatively connected to said first thermistor, said controller operatively connected to said second thermistor, and said controller operatively connected to said pump;

storing a default first temperature in said controller;

monitoring the second temperature received by said controller from said second thermistor;

comparing the second temperature to the default first temperature by said controller;

sending a first signal from said controller to said pump when a first set point is reached based on the comparison of the second temperature to the default first temperature by said controller, the first signal activating said pump;

monitoring the first temperature received by said controller from said first thermistor, the monitoring of the first temperature occurring while said pump is activated;

comparing the second temperature to the monitored first temperature by said controller;

sending a second signal from said controller to said pump when a second set point is reached based on the comparison of the second temperature to the monitored first temperature by said controller, the second signal deactivating said pump;

discontinuing the monitoring of the first temperature by said controller when said pump is deactivated; and storing an updated first temperature in said controller when said pump is deactivated by the second signal.

10. The method according to claim 9, wherein said first set point occurring when the difference between the first default temperature and the second temperature is greater than a first set temperature.

11. The method according to claim 10, wherein said second set point occurring when the difference between the first temperature and the second temperature is less than a second set temperature.

12. The method according to claim 11, further comprising:

comparing the second temperature to the updated first temperature by said controller while said pump is deactivated; and sending a third signal from said controller to said pump when the first set temperature is reached, the third signal activating said pump.

13. The method according to claim 12, wherein the first set temperature is about ten degrees Fahrenheit.

14. The method according to claim 13, wherein the second set temperature is about ten degrees Fahrenheit.

15. The method according to claim 14, further comprising:

comparing the second temperature to a third set temperature by said controller; and sending a fourth signal from said controller to said pump if the second temperature is less than the third set temperature, the fourth signal activating said pump.

16. The method according to claim 15, further comprising:

comparing the second temperature to the third set temperature by said controller; and sending a fifth signal from said controller to said pump if the second temperature is greater than the third set temperature, the fifth signal deactivating said pump.

17. The method according to claim 16, wherein said third set temperature is about one hundred thirty-five degrees Fahrenheit.

18. The method according to claim 17, further comprising a first relay, said first relay operatively connected to said controller and said relay operatively connected to said pump.

19. The method according to claim 18, wherein said second thermistor further comprising a second temperature sensor, said second temperature sensor measuring said second temperature of said storage tank, said second temperature sensor being positioned within said storage tank.

20. The method according to claim 19, wherein said first thermistor further comprising a first temperature sensor, said first temperature sensor measures said first temperature of said tankless, said first temperature sensor being positioned on a surface of said tankless.

* * * * *